US005899074A

United States Patent [19]

Komatsu et al.

[11] Patent Number: 5,899,074

[45] **Date of Patent: * May 4, 1999**

[54] GAS TURBINE COMBUSTOR AND OPERATION METHOD THEREOF FOR A DIFFUSSION BURNER AND SURROUNDING PREMIXING BURNERS SEPARATED BY A PARTITION

[75] Inventors: Yasutaka Komatsu; Haruo Urushidani; Shigeru Azuhata; Nobuyuki Iizuka; Yasuyuki Watanabe; Hiroyuki Arai, all of Hitachi; Nariyoshi Kobayashi, Hitachinaka; Masaya Ohtsuka, Hitachi; Kazuyuki Ito, Hitachinaka, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/416,651

[22] Filed: Apr. 5, 1995

[30] Foreign Application Priority Data

Apr. 8, 1994 [JP] Japan ..... 6-70416

[51] Int. Cl.[6] ..... F02C 3/14; F02C 7/228

[52] U.S. Cl. ..... 60/737; 60/747; 60/746; 60/39.21

[58] Field of Search ..... 60/737, 738, 747, 60/748, 39.21, 746, 739, 733

[56] References Cited

U.S. PATENT DOCUMENTS

| | | | |
|---|---|---|---|
| 3,166,904 | 1/1965 | Melnric | 60/746 |
| 4,292,801 | 10/1981 | Wilkes et al. | 60/747 |
| 4,720,971 | 1/1988 | DuBell | 60/261 |
| 4,817,389 | 4/1989 | Holladay et al. | 60/746 |
| 4,903,478 | 2/1990 | Seto et al. | 60/739 |
| 5,289,685 | 3/1994 | Hoffa | 60/746 |
| 5,303,542 | 4/1994 | Hoffa | 60/746 |
| 5,319,936 | 6/1994 | Ikeda et al. | 60/737 |
| 5,321,949 | 6/1994 | Napoli et al. | 60/739 |
| 5,328,355 | 7/1994 | Kobayashi et al. | 60/747 |
| 5,339,635 | 8/1994 | Iwai et al. | 60/737 |
| 5,343,693 | 9/1994 | Komatsu et al. | 60/737 |
| 5,359,847 | 11/1994 | Pillsbury et al. | 60/748 |
| 5,361,586 | 11/1994 | McWhirter et al. | 60/737 |

FOREIGN PATENT DOCUMENTS

| | | |
|---|---|---|
| 60-91141 | 5/1985 | Japan . |
| 60-218535 | 11/1985 | Japan . |
| 61-22106 | 1/1986 | Japan . |
| 61-22127 | 1/1986 | Japan . |
| 61-52523 | 3/1986 | Japan . |
| 61-153316 | 7/1986 | Japan . |
| 63-161318 | 7/1988 | Japan . |
| 2-100060 | 8/1990 | Japan . |

*Primary Examiner*—Timothy S. Thorpe
*Assistant Examiner*—Ted Kim
*Attorney, Agent, or Firm*—Fay, Sharpe, Beall, Fagan, Minnich & McKee

[57] ABSTRACT

A gas turbine combustor having a fuel injection nozzle for diffusion combustion disposed in a central portion of the combustor and an annular premixed nozzle disposed in an outer peripheral portion of the fuel injection nozzle for injecting a mixed gas of fuel and air. The annular premixed nozzle includes an annular premixing chamber and a plurality of premixed fuel nozzles for injecting fuel into the annular premixing chamber. The annular premix nozzle is divided by a partition (108) to form a plurality of premixing chambers each adjacent to the fuel injection nozzle for diffusion combustion. Each of the premixing chambers includes at least one of the premixed fuel nozzles. A mechanism is provided for supplying fuel to a predetermined number of the premixing chambers in a low load operation of the gas turbine and for supplying fuel to all of the premixing chambers in a high load operation.

10 Claims, 7 Drawing Sheets

GAS TURBINE COMBUSTOR AND OPERATION METHOD THEREOF FOR A DIFFUSSION BURNER AND SURROUNDING PREMIXING BURNERS SEPARATED BY A PARTITION

BACKGROUND OF THE INVENTION

The present invention relates to a gas turbine combustor and, more particularly, to a gas turbine combustor which is suitable for reduction in emission of nitrogen oxides (hereunder referred to as NOx).

NOx which occurs at time of combustion of natural gas, kerosene, gas oil (light oil), etc. is thermal NOx and occurs through oxidization of nitrogen in the air. The occurrence of the thermal NOx depends highly on temperature. In general, in a gas turbine in which low nitrogen content fuel is used, reduction of flame temperature is a principal concept of low NOx combustion. A combustor of a gas turbine is different from a burner used in boilers, etc.. That is, the fuel flow rate changes according to the gas turbine load. On the other hand, air flow rate is substantially fixed, and the fuel air ration, which is a mass flow ration between fuel and air, changes greatly between a partial load and a 100% rated load. Further, at the rated load, in which the fuel flow rate is a maximum, a lot of air, up to twice as much as the theoretical air flow rate necessary to effect complete combustion of fuel, is supplied. Therefore, a lean burn which forms a flame with much excess air can be employed, and the lean burn is a leading technology in a method of reduction of NOx adapted in the current combustor.

Combustion methods of gas fuel are classified into a diffusion combustion method of burning fuel while mixing the fuel with air and a premixed combustion method of premixing fuel and air and then jetting the mixture from a nozzle to burn it. The diffusion combustion method is excellent in stability of the flame and is able to form a flame in a wide range of fuel air ratios. However, since the fuel is burned while being mixed with air, the fuel air ration changes greatly, spatially, within the flame, so that even if lean burn is tried, a part of the fuel is burned under the condition of fuel rich combustion. Therefore, the flame temperature is raised partially and a lot of NOx is apt to occur.

In premixed combustion, fuel and air are mixed before they are introduced into the combustion chamber. Therefore, with the premixed combustion method it is easier to provide a uniform fuel air ration within the flame than it is with diffusion combustion, and the formation of partial temperature elevation due to lock of uniformity of mixing can be avoided, so that an effect of reduction of NOx is large. However, the fuel air ratio range in which the flame is stably formed and the conditions of jetting velocity are narrower than with diffusion combustion. In particular, in an operation of a turbine from starting to 100% load or operation of load interruption at emergency, since the fuel flow rate changes widely, it is difficult to operate the gas turbine only by premixed combustion, so that a two step combustion method is employed in which diffusion combustion is effected from the staring to a partial load and then premixed combustion is started when the turbine goes beyond the partial load. For combustors employing the two step combustion method, there are two kinds, one of which is a combustor in which combustion chambers are provided independently for diffusion combustion and for premixed combustion, respectively, which is disclosed in JP A 61-22106 and JP A 61-22127, for example. An example of the other kind is a combustion in which the diffusion combustion and the premixed combustion are effected in the same combustion chamber, which is disclosed in JP A 63-161318.

Further, since the fuel air ratio increases and the flame temperature elevates according to an increase in the gas turbine load or an increase in the fuel flow rate, NOx increases according to the increase in load. When the two step combustion method is employed, the NOx emission amount can be reduced after staring of the premixed combustion, but the NOx occurrence amount increases during the diffusion combustion before starting of the premixed combustion. In order to suppress NOx occurrence over a wide load range, the premixed combustion is started at a load as low as possible, but it is necessary to suppress NOx occurrence in the diffusion combustion.

In order to form a premixed flame, it is necessary to set the injection velocity of the mixture and the fuel air ratio within a range. When the injection velocity becomes larger and the fuel air ratio becomes smaller, the flame is blown out, and when the injection velocity becomes lower and the fuel air ratio becomes larger, the flame comes into the mixture injection nozzle, and so-called back fire takes place. The amounts of fuel and air necessary to form the flame are determined by the outlet diameter of the nozzle. If the outlet diameter of the nozzle is made larger, the amount of fuel and air necessary to inject at a velocity necessary for stable combustion increases, and a gas turbine load at which a premixed combustion can be effected becomes higher. If the outlet diameter of the nozzle is made smaller, a premixed flame can be formed stably by a small amounted of fuel and air, but an amount of fuel in which the premixed combustion can be effected becomes small and a ratio of the amount of fuel to be burned by the diffusion combustion increases, so that the amount of NOx occurrence increases. Therefore, when it is intended to reduce NOx during a high load operation, the premixed nozzle is made larger, so that a gas turbine load at which the gas turbine is operated by premixed combustion becomes high.

As an example of a combustor for addressing the above-mentioned subjects, a combustor provided with a mechanism for adjusting an air flow rate for diffusion combustion and premixed combustion, and reducing NOx, CO, etc. over a wide load range by optimizing the air flow rate distribution is already proposed in JP A 60-91141, JP A 60-218535, JP A 61-153316 and JP A 61-52523, for example. A combustor in which a plurality of premixed nozzles are provided and the number of the premixed nozzles in use is changed according to load also is proposed in JP U 2-100060 (Laid-Open Utility-Model Application), for example.

The gas turbine can be operated with less NOx emission. However, in order to improve further the performance, there is the following subject to be addressed. When the combustion chamber is divided, each of diffusion combustion and premixed combustion is independently effected so that flames can be prevented from interfering with each other and stable flames can be formed. However, combustion air also is divided into air for diffusion combustion flame and air for premixed combustion flame, and a ratio of the premixed combustion can not be increased. In case diffusion flame and premixed flame are formed in the same combustion chamber and the combustion air is used commonly for both diffusion combustion and for premixed combustion, for example, when the gas turbine load is low, there is a problem to be solved as the fuel air ratio in diffusion flame becomes small by air for premixed flame and unburned components become easy to exhausted.

Further, in order to reduce NOx further in a wide range of loads, it is necessary that the premixed nozzle be made large to increase the ratio of the premixed combustion. The premixed combustion is started from a low load, and NOx occurred during the diffusion combustion is made as small as possible.

Of the above-mentioned prior art, in the combustor provided with an air flow adjustment mechanism, when the air amount for premixed combustion is increased in order to effect premixed combustion at a low load, injection velocity of premixed fuel air also becomes low and there is a possibility of back fire occurring. Therefore, in particular, when the premixed nozzle outlet diameter is made large, it is insufficient to reduce the load at which the premixed combustion starts.

On the other hand, in the combustor which is provided with a plurality of premixed nozzles and the number of the nozzles in use is changed according to load, since the construction is such that the plurality of annular premixed nozzles are provided concentrically with an axis, when the number of the premix nozzles in use increases, the next nozzle has to be ignited with a relatively low temperature premixed flame, so that there is a problem that ignitability of the premix nozzle of the second stage or later stages worsen. Further, there are problems such that an area in which flames of adjacent premixed nozzles contact each other is large, the premixed flames interfere with each other, pressure change (combustion vibration) becomes large and the life of the combustor shortens.

SUMMARY OF THE INVENTION

An objective of the present invention is to provide a gas turbine combustor which can effect stable combustion over a wide load range and reduce NOx.

Another objective of the present invention is to provide a combustor in which diffusion combustion and premixed combustion are effected in the same combustion chamber and combustion stability and operation are improved.

A gas turbine combustor according to the present invention has a fuel injection nozzle for diffusion combustion, disposed in a central portion of the combustor and an annular premixed nozzle for injecting a gas mixture of fuel and air, arranged in an outer periphery of the fuel injection nozzle. The annular premixed nozzle is divided circumferentially to form a plurality of premixing chambers and the combustor is constructed so that fuel is supplied into a predetermined number of premixing chambers and the plurality of premixing chambers at the time of low load operation of the gas turbine, and fuel is supplied into all the plurality of premixing chambers at the time of high load operation.

Further, a stabilizer for generating eddies in the mixture gas can be provided in the vicinity of the outlet of the gas mixture in the premixed nozzles.

Further, air flow adjusting means for adjusting air flow rate for each premixing chamber, supplied into the plurality of the premixing chambers can be provided.

Further, a gas turbine combustor according to the present invention has a fuel injection nozzle for diffusion combustion, disposed in a central portion of the combustor and an annular premixed nozzle for injecting a gas mixture of fuel and air, arranged in a periphery of the fuel injection nozzle. A stabilizer which is a resistor of circular flow is provided in the vicinity of the gas mixture outlet of the premixed nozzle. The diffusion combustion fuel nozzle is disposed at an upstream side of the mixture, the diffusion combustion nozzle is radially spaced from the premixed nozzle so that circulation flows, sufficient to form stably diffusion flames, are formed therebetween, and a conical partition wall is provided between the diffusion combustion fuel nozzle and the premixed nozzle.

Further, the diffusion combustion fuel nozzle is characterized in that the air is sufficient to generate swirling flows in the fuel for diffusion combustion is swirled by the air and injected.

Further, the above-mentioned partition wall is characterized in that the partition wall is cooled by combustion air for diffusion combustion and the cooling air is introduced in the vicinity of the premixed nozzle and then injected into the combustion chamber.

It is preferable that the radial distance between the diffusion combustion fuel nozzle and the premixed nozzle is 0.2 to 0.4 in ratio to an inner ring of the premixed nozzle and a spread angle of the conical partition wall is 30° and 60° from a face of the outlet of the premixed nozzle.

Further, another feature of the present invention, utilizing a method of a gas turbine combustor having a plurality of premixed nozzles and a plurality of flow control systems for supplying fuel into the premixed nozzles and changing the number of the premixed nozzles to be operated according to load, resides in that when the number of the premixed nozzles in operation is increased, a fuel amount for the premixed nozzles operated before and after the increase is decreased and fuel is supplied into the newly operated premixed nozzles, and when the number of the premixed nozzles in operation is decreased, a fuel amount for the premixed nozzles to be stopped to operate is decreased, and a fuel amount for the remaining premixed nozzles which are operating is increased.

According to the gas turbine combustor of the present invention, the annular premixed nozzle disposed in the periphery of the fuel injection nozzle for diffusion combustion arranged around the central portion of the combustor is circumferentially divided to form a plurality of premixing chambers and when the gas turbine operates at a low load, that is, when fuel flow rate is small, fuel is supplied to only a predetermined number of the premixing chambers of the plurality of the premixing chambers, so that a fuel air ratio in the premixing chambers in use can be raised a magnification of the division number. Therefore, by increasing the division number of the premixed nozzle, premixed combustion can start at a lower load and a NOx value at a partial load can be reduced.

Further, all the premixed gas injected from each of divided premixed nozzles can contact with flames of the diffusion combustion nozzle provided at the central portion. Therefore, each of the premixed nozzles can be ignited by the diffusion flame which is higher in temperature than the premixed flame, and the number of the premixed nozzles in use can be increased more stably during increase in the load.

Further, when a plurality of premixed nozzles are used, an area in which adjacent premixed flames contact each other is small, interference of premixed flames with each other becomes less and combustion vibration is reduced.

Further, by providing a flame stabilizer at mixture outlets of the premixed nozzles, stabilization of flame and ignitability can be improved further.

Further, by providing the air flow adjusting means for adjusting air flow for each of the premixing chambers supplied into the plurality of premixing chambers, the air flow rate can be increased and a desired fuel air ratio can be maintained even under such conditions of operation that the fuel air ratio reduces at low load. In this case, compensation for the air flow rate can be small as compared with an air flow rate compensation in the premixed nozzle which is not divided, and the air flow rate becomes easy to be controlled according to a change in load, so that stability of the flame can be improved and NOx can be reduced.

Further, according to the present invention, by providing a conical partition wall between the diffusion combustion nozzle and the premixed nozzle and constructing the combustor so that the diffusion combustion nozzle is disposed upstream of the premixed nozzle, mixing of diffusion fuel and a lot of air injected from the premixed nozzle can be delayed and diffusion flame of a relatively high fuel air ratio and high temperature can be formed in the central portion of the combustor. Further, by radially separating the diffusion combustion fuel nozzle and the premixed nozzle so that circulation flow sufficient to stably form diffusion flame is formed therebetween, stability of the diffusion combustion flame can be further improved. By setting the radial distance between the diffusion combustion fuel injection nozzle and the premixed nozzle to 0.2–0.4 in ratio to the inner ring of the premixed nozzle, the above-mentioned circulation flow can be suitably formed.

Another advantage of forming the partition wall in a conical form is in that the air flow rate for cooling a combustion chamber wall can be reduced because the surface area of the combustion chamber wall upon forming the combustion chamber for diffusion combustion can be made small, compared with a cylindrical combustion chamber. In the low NOx combustor, it is necessary to use the air as much as possible for premixed combustion, and when cooling air is reduced and premixed air is increased, NOx can be reduced according to a decrement of the cooling air and an increment of the premixed air.

In order to reduce further cooling air for the partition wall, air is impinged on the surface of the partition wall on an air supply side, that is, on the side opposite to the combustion chamber, whereby a boundary layer of air on the surface is disturbed and the heat transfer coefficient is raised to effectively cool the surface. The cooling air is injected into the combustion chamber from a portion close to the premixed nozzle so that the air as much as possible can be used for combustion of premixed flame. Where a stabilizer which is a bluff body, in which a resistor for air is provided at the central portion of the premixed gas flow and the flame is stabilized (held) with circulating flows of high temperature combustion gas formed at the downstream side of the resistor is used, flames are formed along the resistor and propagate from the edge portion toward the outer periphery. In the premixed gas flow also, combustion is delayed in the outer peripheral portion as compared with the central portion, and also air from an adjacent portion of the premixed nozzle in addition to air from the interior of the premixed nozzle has the effect of lower the temperature of the premixed flame.

Further, according to a method of the gas turbine combustor relating to another feature of the present invention, when the number of the premixed nozzles in use is increased, the fuel flow rate of the premixed nozzles operated before and after the increase of the nozzle number is decreased and fuel is supplied into the newly operated premixed nozzles, and when the number of the premixed nozzles is decreased, the fuel flow rate of the premixed nozzles, the operation of which is stopped, is decreased and fuel for the remaining premixed nozzles which are operating is increased, so that an abrupt change due to a change in fuel supply amount according to a change in the number of premixed nozzles in operation can be suppressed and a rapid change of load can be prevented.

DESCRIPTION OF PREFERRED EMBODIMENTS

Figure 1:
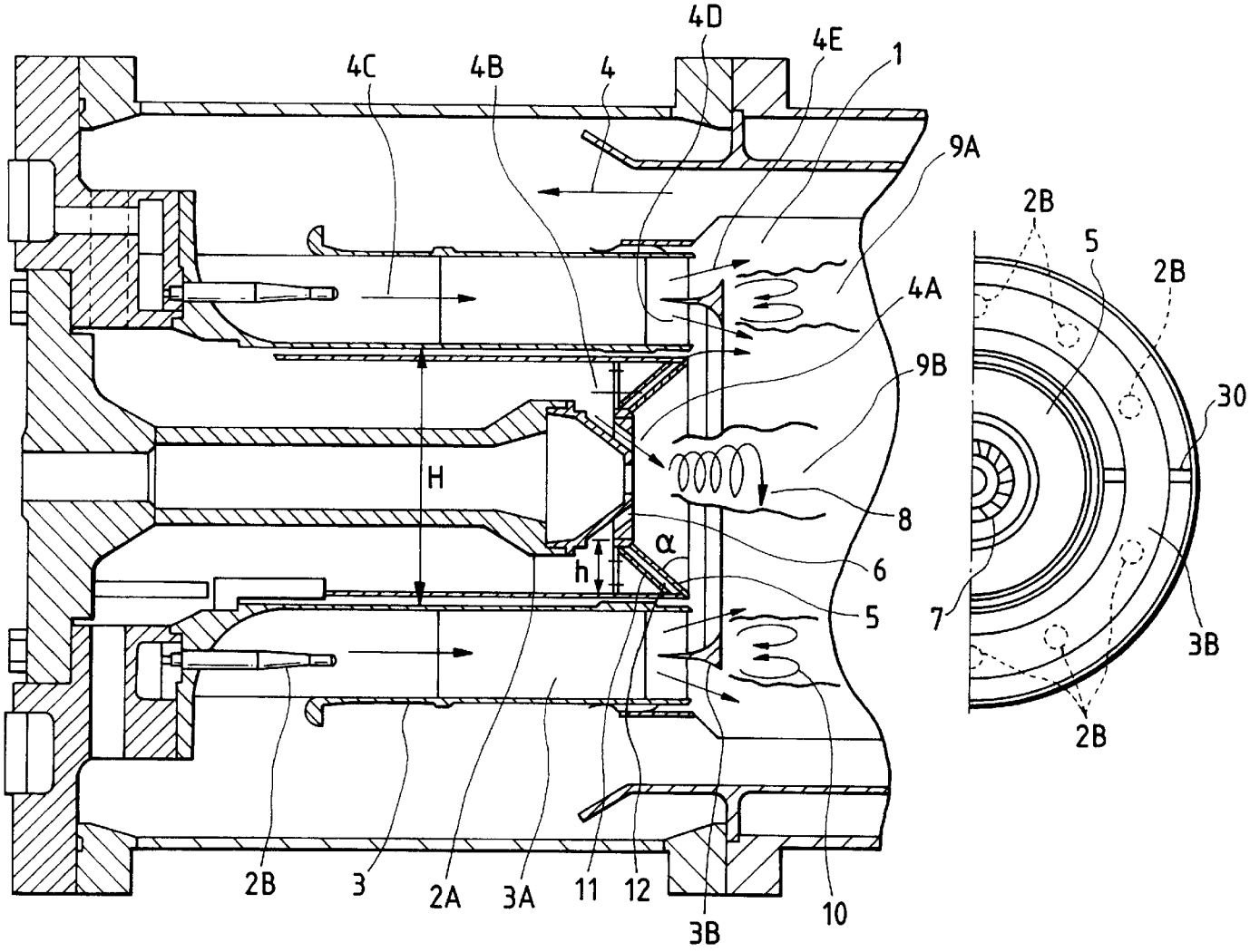
FIG. 1 is a section view of a gas turbine combustor of a first embodiment of the present invention.

FIG. 1 shows an embodiment of the present invention.

A gas turbine comprises an air compressor, a combustor and a turbine. Air from the air compressor is introduced into the combustor, and used for combustion of fuel to turn into high temperature gas which is introduced into the turbine. The combustor comprises a combustion chamber 1, a fuel nozzle 2A for diffusion combustion, a premixed nozzle 3, dividing plates 30 dividing the premixed nozzle 3 into a plurality, and premixing chambers formed by the dividing plates 30. Air 4 for combustion is introduced from a downstream side of the combustor to an upstream side through a cooling liner surface forming the combustion chamber 1. Air supplied into the combustion chamber 1 includes diffusion fuel dispersing air 4A, partition wall cooling air 4B and premixed combustion air 4C. Fuel is injected into the combustion chamber from the diffusion combustion fuel nozzle 2A and premixed combustion fuel nozzles 2B.

The diffusion combustion fuel nozzle 2A is arranged in the central portion of the combustor, and the premixed nozzle 3 which is annular is arranged on the outer periphery thereof by a partition wall 5. The diffusion combustion fuel nozzle 2A is important to be spaced radially from the premixed nozzle 3 so that combustion gas of diffusion flame 9B circulates sufficiently from a downstream side of diffusion flame 9B to a fuel outlet side of the diffusion combustion fuel nozzle 2A. By occurrence of such circulation flow, stability of the diffusion flame 9B can be improved.

The diffusion combustion fuel nozzle 2A injects fuel from its fuel injection port, and the fuel is injected into the combustion chamber 1 together with diffusion fuel dispersing air from flow passages 6 provided on the outer peripheral portion of the fuel injection port. The diffusion fuel dispersing air 4A is swirled by swirling vanes provided at outlets of the flow passages 6 to be swirling flow which is introduced into the combustion chamber 1. When fuel is directly injected as swirling flow 8 without using the diffusion fuel dispersing air 4A, momentum of a swirling component changes depending on a gas turbine load or a fuel flow rate. In order to avoid this phenomena and keep swirling momentum of some extent irrespective of the fuel flow rate, the diffusion fuel dispersing air 4A is introduced to the swirling flow 8. The diffusion fuel dispersing air is sufficient to be an amount of air necessary to impart swirling momentum to injected fuel flow, the amount is 10% or less of an amount of air introduced into the combustor, usually, 2 to 3%. Further, in this embodiment, the diffusion fuel dispersing air 4A is injected toward the center of the combustor.

The annular premixed nozzle 3 comprises a plurality of premixed combustion fuel nozzles 2B, a mixing portion 3A of air introduced at an inlet of the premixed nozzle, and an annular flame stabilizing ring 3B provided at an outlet thereof. Fuel 9A for premixed flame and air is mixed in the mixing portion 3A and injected into the combustion chamber 1. Circulation flows 10 are formed downstream of the flame stabilizing ring 3B at the outlet of the nozzle, the circulation flows 10 become combustion gas of high temperature during premixed combustion, and premixed flame 9A is stabilized by this combustion gas.

In diffusion combustion, air from the premixed nozzle 3 is used for diffusion combustion is employed in low load and at turbine starting. As the load becomes high, both the premixed combustion and the diffusion combustion are effected. Therefore, for the diffusion flame 9B used in a low load operation or in an operation at t small fuel flow rate, air from the premixed nozzle 3 is excessive. When all the air is introduced into the reaction area of the diffusion combustion, misfire takes place or an exhaust amount of unburned substances increases. In the combustor of this embodiment, air from the premixed nozzle 3 is divided by the stabilizing ring 3B into two, one of which is inner periphery air (4D) and the outer is outer periphery air (4E). In this manner, when the air flow is divided, the outer periphery air (4E) is delayed in mixing with fuel for diffusion combustion, air used for diffusion flame 9B formed in the central portion of the combustor is decreased, and a stable flame is easy to be formed.

A conical partition wall 5 is arranged between the diffusion combustion fuel nozzle 2A and the premixed nozzle 3. By this partition wall 5, diffusion combustion fuel is delayed in mixing with combustion air 4, that is air from the premixed nozzle 3 and the stability of the diffusion flame 9B formed in the central portion of the combustor is secured.

Figure 2:
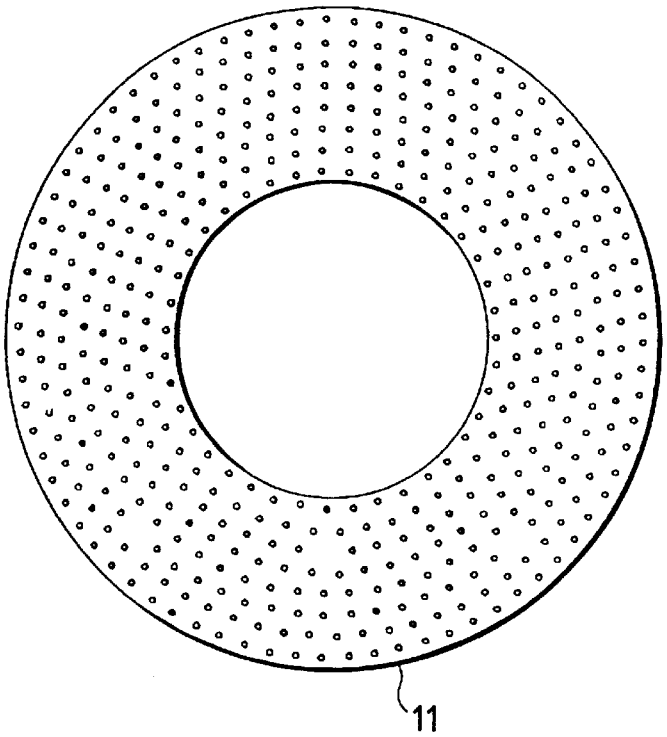
FIG. 2 is a side view of a conical partition wall viewed from an upstream side.
Figure 3:
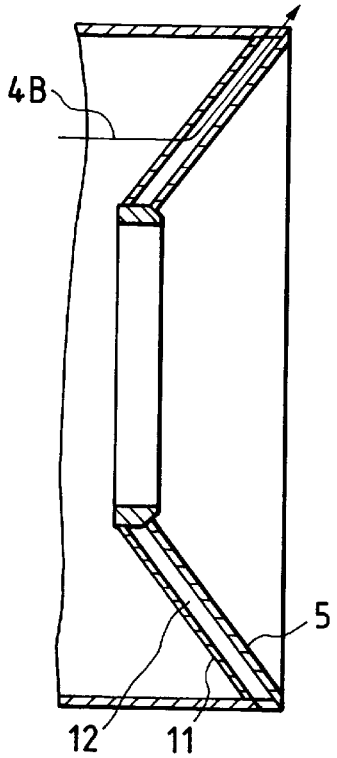
FIG. 3 is a sectional view of the conical partition wall.

Detailed construction of the partition wall 5 is shown in FIGS. 2 and 3. FIG. 2 is a view in which the partition wall 5 is viewed from the upstream side of the combustor. FIG. 3 is an enlarged view of the partition wall 5.

The partition wall 5 is provided with a multi-hole plate 11 substantially in parallel with the partition wall 5 on the upstream side thereof. Air jet flow from the multi-hole plate 11 impinges on the partition wall 5. A distance sufficient to cool the partition wall through the impingement of jet flow from the multi-hole plate 11 is provided between the partition wall 5 and the multi-hole plate 11, and cooling air 4B passes through a flow path 12 and injected into the combustion chamber 1 from a portion in the vicinity of premixed nozzle 3.

In this embodiment, a spreading angle $\alpha$ of the conical partition wall 5 is 34°, the height h is 0.32×H wherein H is the diameter of the inner ring of the annular premixed nozzle, that is, h/H=0.32. The angle $\alpha$ and the ratio h/H are preferable to be in a range of 0.2–0.4, respectively. By setting h/H in such a range, circulating flow of combustion gas of the diffusion flame 9B as mentioned above is formed sufficiently.

Figure 4:
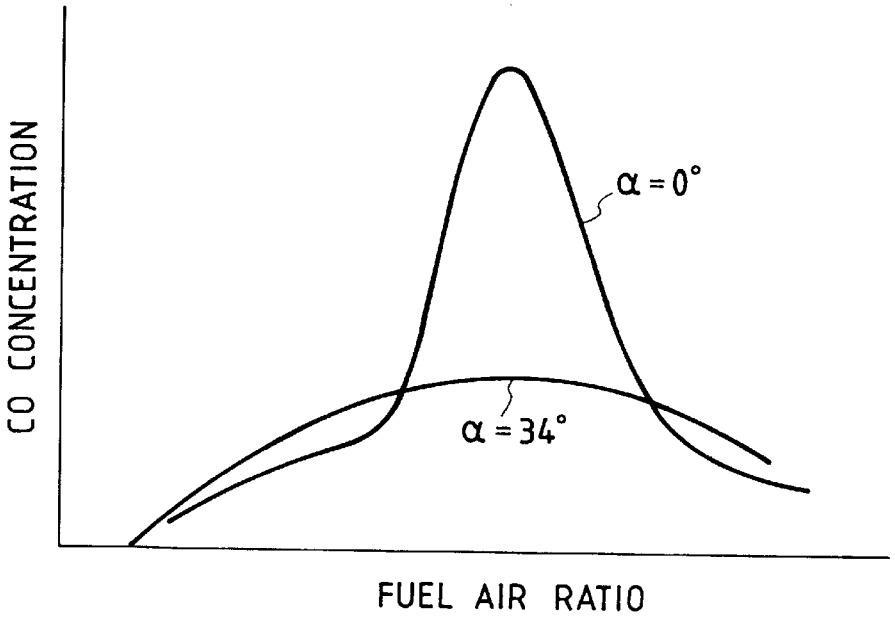
FIG. 4 is a diagram for explanation of CO concentration depending on injection inclination angles of a diffusion fuel injection nozzle.

FIG. 4 shows a comparison of characteristics of CO exhaust between a combustor in which the fuel injection outlet port for the diffusion combustion fuel is disposed on the same face as the premixed nozzle outlet port, that is, the angle $\alpha$=0° in the combustor of the embodiment as shown in FIG. 1. In the combustor of $\alpha$=0°, the CO exhaust amount becomes large at a certain range of fuel air ratio. That is, it is important that the diffusion combustion fuel nozzle is positioned to be at an upstream side and fuel therefrom is dispersed well before the fuel is mixed with air from the premixed nozzle.

A second embodiment of the invention is now explained referring to the drawings.

Figure 5:
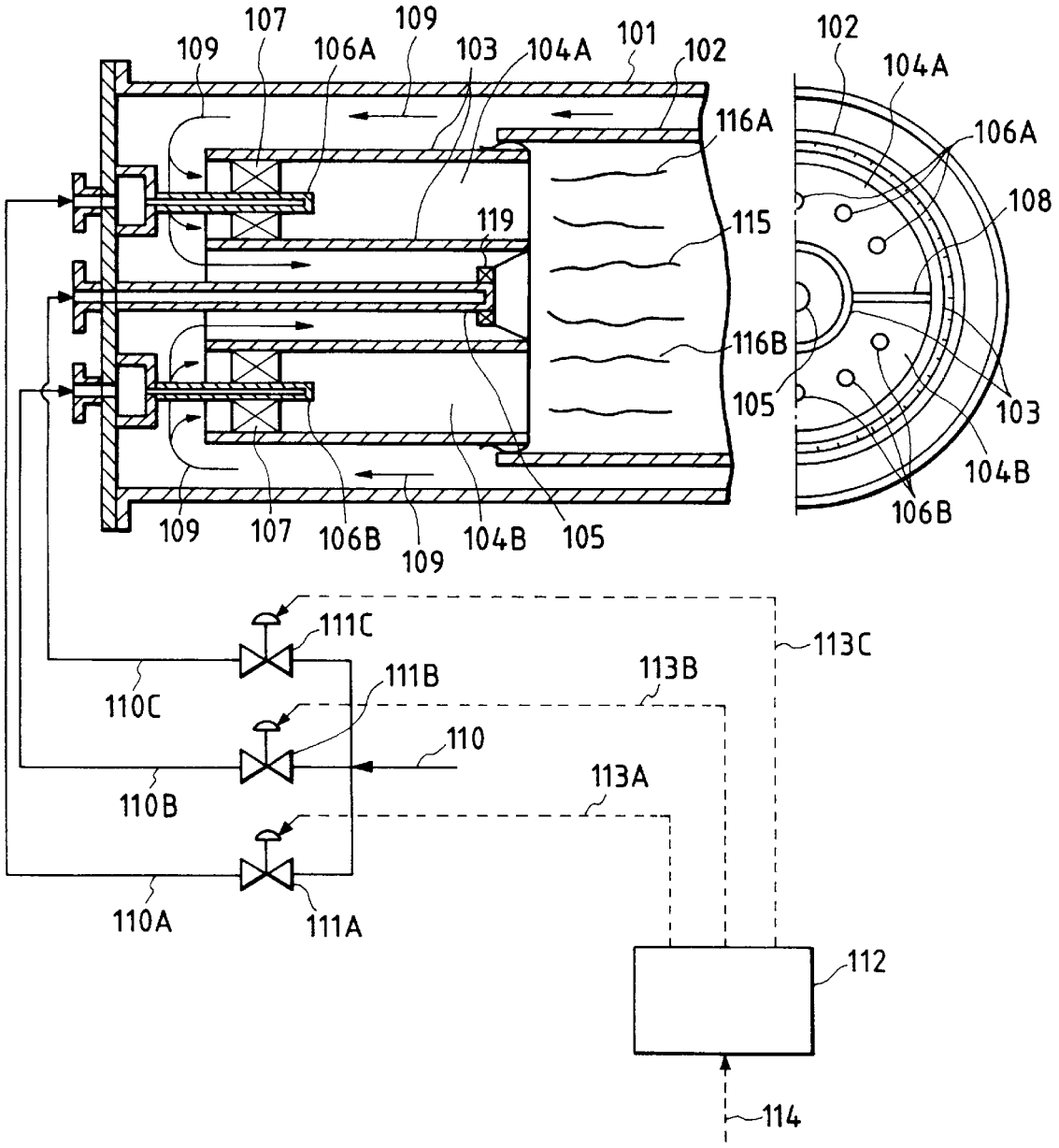
FIG. 5 is a schematic diagram of a combustor of a second embodiment of the present invention.

FIG. 5 shows a low NOx combustor for a gas turbine of the second embodiment. The combustor is provided with a fuel nozzle 105 for diffusion combustion in the central portion and an annular premixed nozzle 103 at an outer peripheral side. The premixed nozzle 103 is divided in a direction towards the circumference thereof into two by a dividing plate 108, whereby a premixing chamber 104A of upper half and a premixing chamber 104B of lower half are formed.

High pressure air 109 from a compressor (not shown) passes through between an outer cylinder 101 and an inner cylinder 102 forming therein a combustion chamber and is branched into air for the premixed nozzle 103 and air for the diffusion fuel nozzle 105. The air for the premixed nozzle 103 passes through swirlers 107 provided at the inlet of the premixed nozzle 103, and is premixed with fuel from the premixed nozzles 106A, 106B in the premixing chambers 104A and 104B, and the premixed gas is burned at the outlet of the premixed nozzle 103 to form premixed flames 116A, 116B. Further, the premixed flames are stabilized by swirling of air having passed through the swirlers 107.

On the other hand, air for the diffusion combustion fuel nozzle 105 passes through between the premixed nozzle 103 and the diffusion combustion fuel nozzle 105, and the air is swirled by a swirler 119 and injected into the combustion chamber together with fuel. The diffusion combustion fuel is burned while being mixed with air injected from the premixed nozzle 103 to form diffusion flames 115. Therefore, air for the diffusion combustion fuel nozzle 105 is sufficient to be an amount of air necessary to spread fuel jet flow so that the diffusion combustion fuel can be mixed with air jetted from the premixed nozzle 103 and the air can be an amount less than an amount of air necessary for diffusion combustion.

Fuel 110 is divided into fuel supplied for each nozzle by a fuel flow controller 112 on the bases of gas turbine load 114. Namely, fuel 110C for diffusion combustion is supplied into the diffusion combustion fuel nozzle 105, with opening of fuel control valve 111C. That is, the fuel rate is adjusted by control signal 113C from the fuel flow controller 112. In the same manner, premixed combustion fuel 110A (or 110B) is supplied into the premixed combustion fuel nozzle 106A (160B). That is, the fuel flow rate is adjusted by control signal 113A (113B) from the fuel flow controller 112, and mixed with air in the premixing chamber 104 (104B). The fuel nozzles 106A, 106B for supplying fuel into the premixing chambers 104A, 104B are five in number, respectively, however, any number of nozzles can be applied so long as the mixing degree of fuel and air does not worsen.

Figure 6:
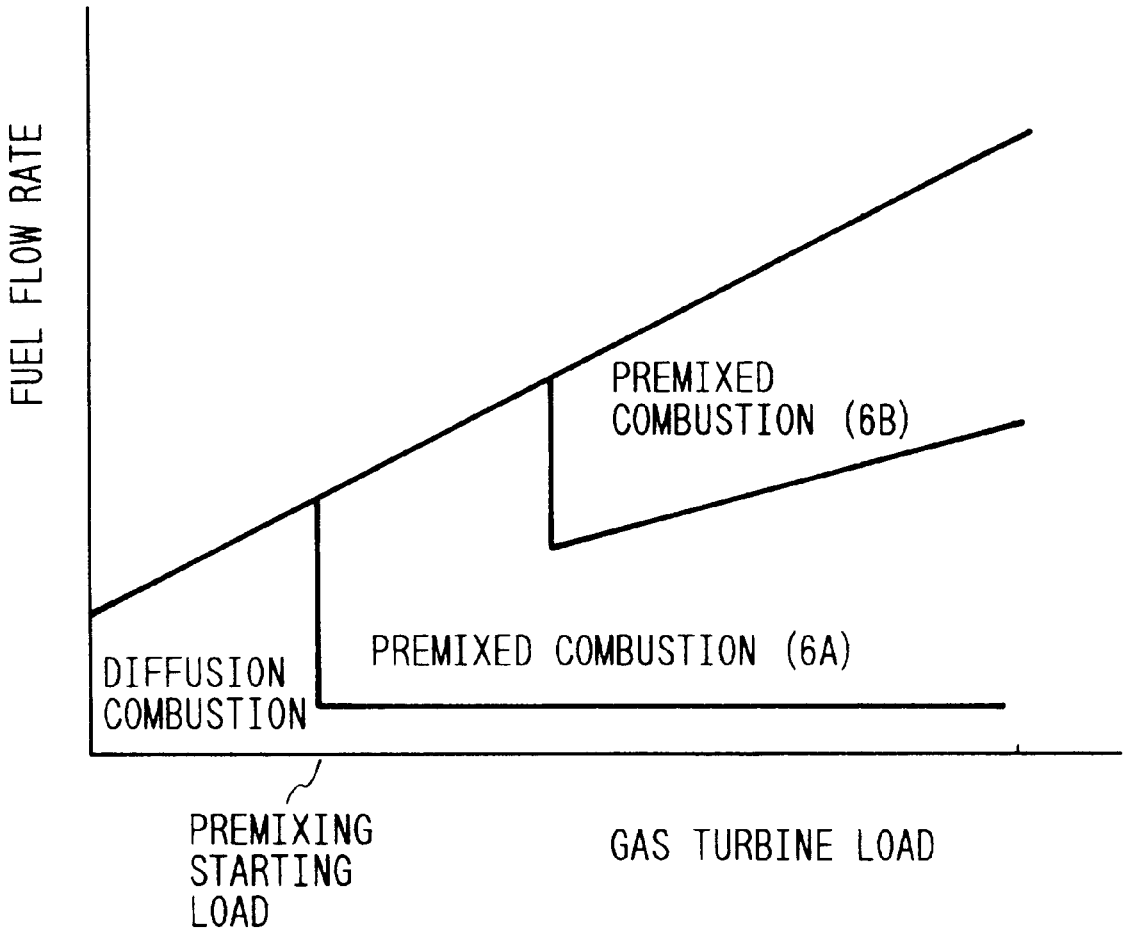
FIG. 6 is a diagram for explanation of an example of an application of fuel flow rate in the combustor of the present invention.

Next, combustion control operation of the above-mentioned combustor is explained. As shown in FIG. 6, in an operation under low load, fuel is supplied to only the diffusion combustion fuel nozzle 105 to effect only diffusion combustion operation. When the turbine reaches a load at which premixing combustion is started, the diffusion combustion fuel is decreased and fuel is supplied into the premixed combustion fuel nozzles 106A of the upper half by the decrement of the diffusion combustion fuel, and the combustor is operated by the diffusion combustion fuel nozzle and the premixed combustion fuel nozzles 106A of the upper half. In a further high load operation, fuel for the premixed combustion fuel nozzle 106A of the upper half is reduced to a half and the same amount of fuel is supplied into the premixed combustion fuel nozzles 106B of the of the lower half, whereby all the fuel nozzles 106A and 106B are operated, and the load is raised to a full load while being controlling so that the fuel air ratios in the two premixed nozzles are equal to each other. The fuel air ratio of the premixed nozzles and NOx concentration at the outlet of the combustor at this time are shown by solid lines in FIGS. 7 and 8.

Figure 7:
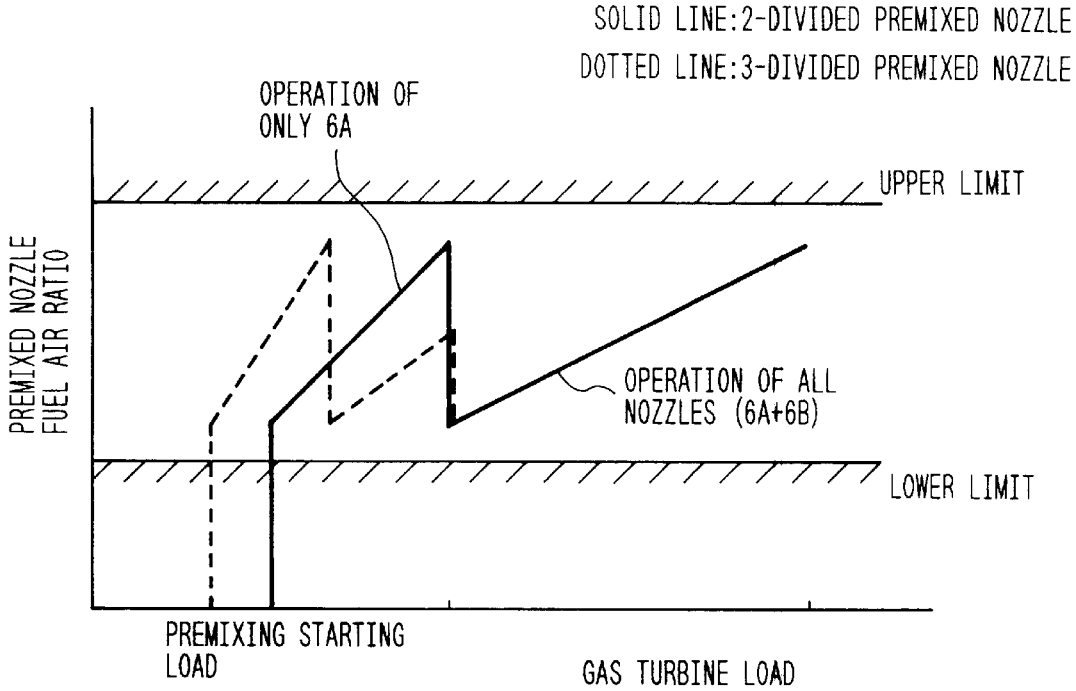
FIG. 7 is a diagram for explanation of an example of the application of fuel air ratio for the premixed nozzle of the combustor of the present invention.
Figure 8:
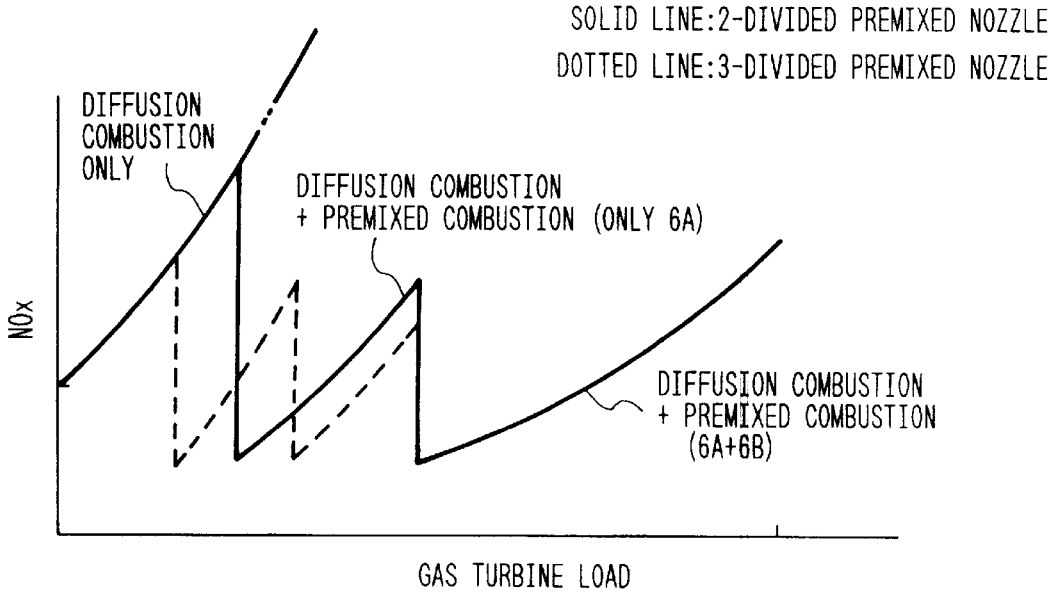
FIG. 8 is a diagram showing an example of NOx characteristics in the combustor of the present invention.

In FIG. 7, an upper limit and a lower limit of fuel air ratio in which stable premixed combustion can be effected are shown. It is necessary to operate the premixed nozzle in this range defined by the upper and lower limit values, so that if there is a difference in the fuel air ratio between the plurality of premixed nozzles 6A, 6B when the nozzles are operated, an operable range of load becomes narrow. Therefore, it is necessary to control the fuel air ratio so that all the fuel air ratios of the premixed nozzles 6A, 6B in operation are equal to each other. Further, when fuel is supplied to only the premixed nozzles 6A of upper half, the fuel air ratio of each of the premixed nozzles 6A, 6B becomes twice the fuel air ratio of each of all the premixed nozzles 6A, 6B, so that by dividing the premixed nozzle 103 into two, premixed combustion can be started at a load corresponding to a fuel flow rate about ½ the flow rate in the premixed nozzle which is not divided. As a result, an operation load under which only diffusion combustion is effected is lowered, as shown in FIG. 8 NOx value can be decreased on in the diffusion combustion operation, and low NOx can be realized in a wide range of the load. Further, in this embodiment, the premixed nozzle 103 is divided into 2, and by increasing the number of divisions the load at which premixing starts can be further lowered and the NOx value only in diffusion combustion operation can be further decreased. For reference, characteristics of NOx in case of the premixed nozzle which is equally divided into 3 are shown by dotted line in FIGS. 7 and 8.

Figure 9:
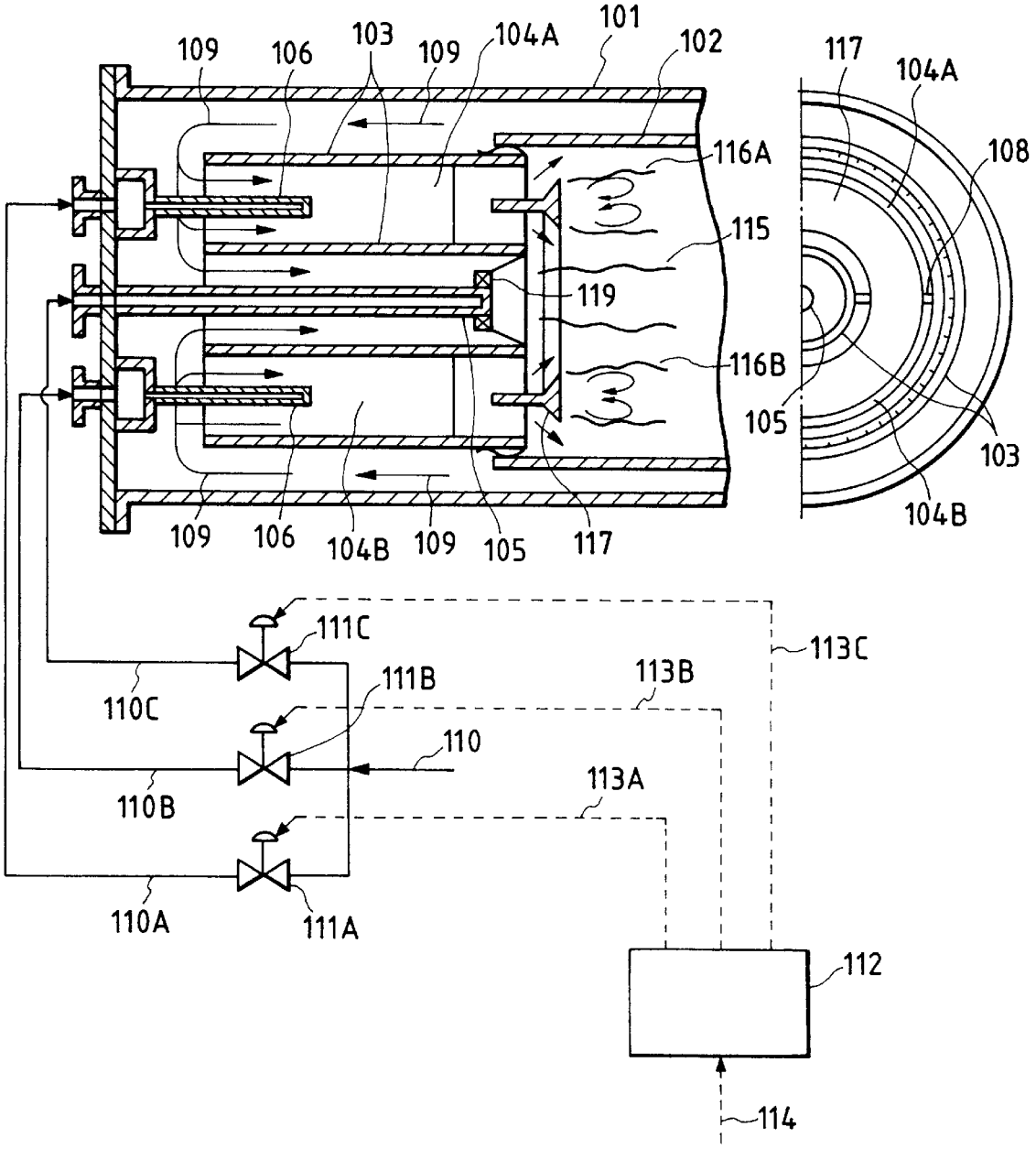
FIG. 9 is a schematic diagram of a combustor of another embodiment of the present invention.

Next, another embodiment of the present invention is explained referring to FIG. 9.

In FIG. 9, a combustor of this embodiment, as compared with the combustor of the second embodiment, is not provided with the swirler 107 at the inlet of the premixed nozzle 103, and is provided with stabilizer 117 at the outlet of the premixed nozzle 103 instead thereof. The stabilizer 117 is formed in an annular configuration corresponding to the annular premixed nozzle. The cross section thereof is an isosceles triangle, the apex of which is oriented to the upstream side. The stabilizer 117 holds the premixed flames 116A, 116B by circulation flows generated in the downstream side of stabilizer 117.

Holding or stabilizing of the premixed flame by the stabilizer 117 can decrease NOx more than holding stabilizing of swirling flows by the swirler 107 shown by the second embodiment because a fuel air ratio range in which stable combustion is possible is large and the fuel air ratio of premixed gas can be made small. A flow direction of premixed gas at the outlet of the premixed nozzle 103 is deflected in the direction of the diameter by the stabilizer 117. Namely, gas flow in the premixed nozzle 103 around the axis is deflected further toward the axis by the stabilizer 117. Conversely, the gas flow in the premixed nozzle 103 at the outer diameter side is deflected further toward the outer diameter side. Therefore, in the case where the stabilizer is applied to a combustor which is provided with a plurality of premixed nozzles arranged concentrically with an axis as shown in the prior art, since the premixed nozzles are placed in the diameter direction, flames at the outlets of adjacent premixed nozzles violently interfere with each other. As a result, there is a problem that combustion vibration becomes violent. Therefore, such a nozzle is necessary to be divided circumferentially and prevent interference between the premixed flames, as in the present invention.

Figure 10:
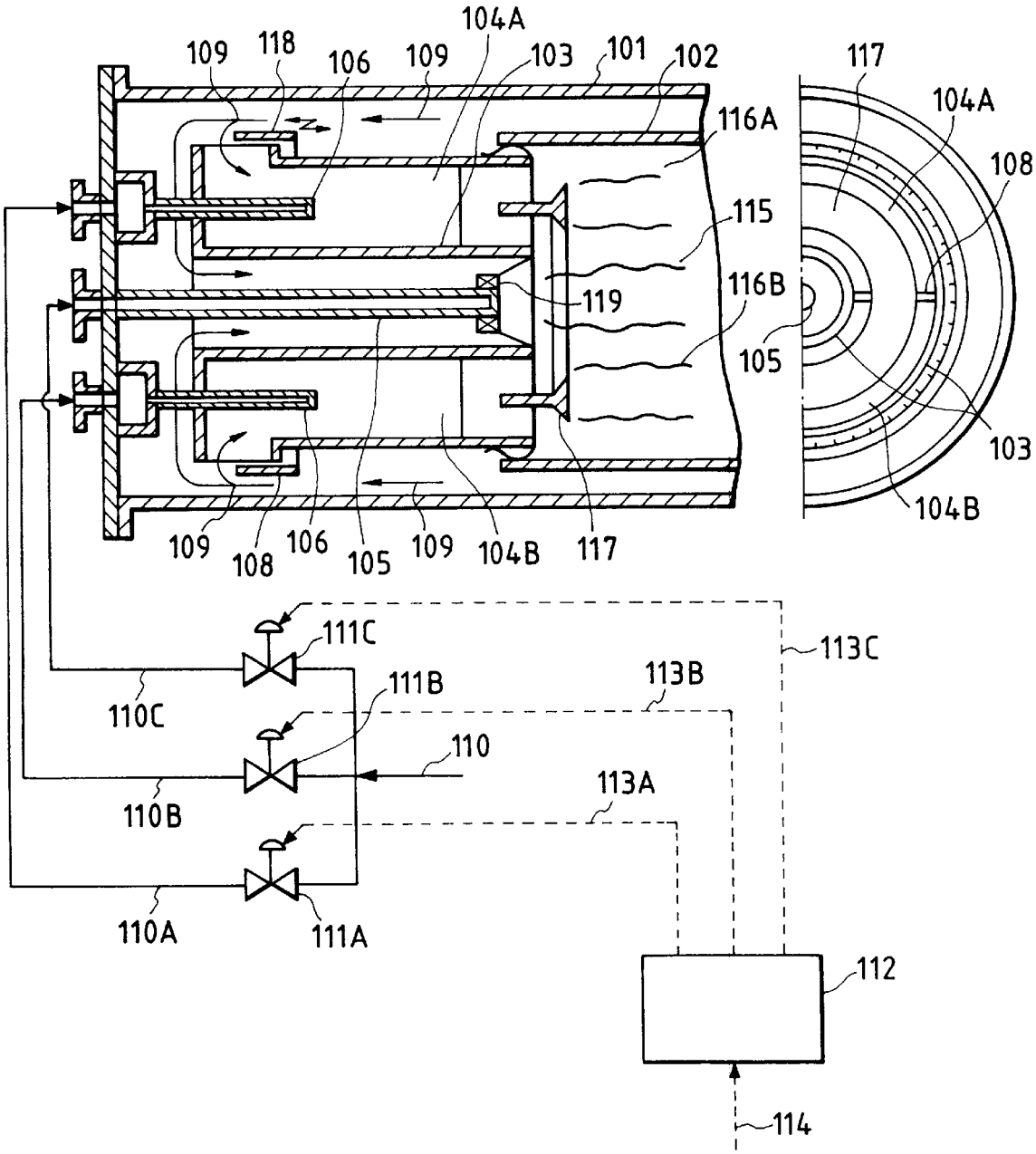
FIG. 10 is a schematic diagram of a combustor of still another embodiment of the present invention.

Next, a combustor of another embodiment of the present invention is explained referring to FIG. 10. The combustor of this embodiment, as compared to the combustor of the second embodiment, has a premixed nozzle 103 which is bent in a L-letter shape in an axially vertical section and has an inlet directed to the outer diameter side, and an air flow adjustment mechanism 118 disposed at the inlet. Further, a drive mechanism (not shown) also is provided for axially moving the air flow adjustment mechanism 118.

The air flow adjustment mechanism 118 is shifted axially, whereby the inlet opening area of the premixed nozzle 103 changes, and a flow rate of air entering the premixed nozzle 103 can be changed. Therefore, when a fuel air ratio of the premixed nozzle such as the premixing starting load becomes low, the fuel air ratio of the premixed nozzle can be increased by decreasing the premixed combustion air flow rate by utilizing the air flow adjustment mechanism 118. Further, as a load or a fuel flow rate increases, air for premixed combustion can be increased, so that change in the fuel air ratio can be small and the NOx is decreased further to stabilize the combustion.

Further, in case of bending the premixed nozzle 103 in a L-letter shape in the section in order to mount the air flow adjustment mechanism 118, as in this embodiment, since the premixed nozzles are arranged in the diameter direction in the prior art, the position of each nozzle inlet directed to the outer diameter side is necessary to be shifted to the axis direction. As a result, the inner diameter side nozzle and the outer diameter side nozzle are different from each other in the length of the premixing chamber, respective nozzles are different in flow rate characteristics, mixing characteristics, etc., and there is a problem that uniform combustion is difficult. However, the problem is solved by dividing the premixed nozzle in the circumferential direction, as in the present invention.

According to the present invention, mixing of fuel and a lot of air is delayed, so that a diffusion flame of high temperature can be formed in the central portion of the combustor, and divided air for diffusion combustion is swirled, so that high temperature circulating flows can be formed in the downstream side of the diffusion combustion fuel nozzle, whereby stability of the diffusion flame can be improved further and unburned components, such as CO, can be reduced further.

Further, by making the partition wall in a conical shape, the surface area of the combustion chamber for diffusion combustion can be made small, an amount of cooling air can be reduced by the decrement, whereby NOx can be reduced by increasing air for premixed combustion.

Further, according to the present invention, the premixed nozzle can be used partially, so that the premixing starting load can be lowered, and low NOx operation is possible in a wide load range.

What is claimed is:

1. A gas turbine combustor having a fuel injection nozzle for diffusion combustion disposed in a central portion of the combustor, and an annular premixed nozzle disposed adjacent an outer peripheral portion of the fuel injection nozzle for injecting mixed gas of fuel and air without any other nozzle intervening between said fuel injection nozzle and said annular premixed nozzle, wherein said annular premixed nozzle comprises an annular premixing chamber and a plurality of premixed fuel nozzles for injecting fuel into said annular premixing chamber, and is divided in a circumferential direction by partition means to form a plurality of premixing chambers each adjacent to said fuel injection nozzle for diffusion combustion so that premixed gas from said premixing chamber directly contacts a flame from said fuel injection nozzle, each of said premixing chambers including at least one of said premixed fuel nozzles; and a mechanism is provided for supplying fuel to a predetermined number of said premixing chambers in a low load operation of the gas turbine, and for supplying fuel to all of said premixing chambers in a high load operation.

2. A turbine combustor according to claim 1, wherein said partition means comprises at least one plate radially and axially extending to form said plurality of premixing chambers.

3. A turbine combustor according to claim 2, wherein a swirler is provided at a downstream side end of said fuel injection nozzle for diffusion combustion.

4. A turbine combustor according to claim 3, wherein swirlers are provided around air inlet portions of said premixing chambers for swirling air entered the premixing chambers to mix with fuel from said premixed fuel nozzles in said premixing chambers.

5. A gas turbine combustor having a fuel injection nozzle for diffusion combustion disposed in a central portion of the combustor, and an annular premixed nozzle disposed adjacent an outer peripheral portion of the fuel injection nozzle for injecting mixed gas of fuel and air without any other nozzle intervening between said fuel injection nozzle and said annular premixed nozzle, wherein said annular premixed nozzle comprises an annular premixing chamber and a plurality of premixed fuel nozzles for injecting fuel into said annular premixing chamber, and is divided in a circumferential direction by partition means to form a plurality of premixing chambers, each adjacent to said fuel injection nozzle for diffusion combustion so that premixed gas from said premixing chamber directly contacts a flame from said fuel injection nozzle, each of said premixing chambers including at least one of said premixed fuel nozzles;

a fuel control valve is provided on each fuel line for supplying fuel to said plurality of premixed fuel nozzles;

a fuel flow controller is provided for outputting opening control signals to said fuel control valves; and a mechanism is provided for supplying fuel to a predetermined number of said premixing chambers in a low load operation of the gas turbine, and for supplying fuel to all of said premixing chambers in a high load operation.

6. A turbine combustor according to claim 5, wherein said annular premixed nozzle is divided by at least one dividing plate radially and axially extending to form said plurality of premixing chambers.

7. A turbine combustor according to claim 6, wherein a swirler is provided at a downstream side end of said fuel injection nozzle for diffusion combustion.

8. A turbine combustor according to claim 7, wherein swirlers are provided around air inlet portions of said premixing chambers for swirling air entered the premixing chambers to mix with fuel from said premixed fuel nozzles in said premixing chambers.

9. A turbine combustor having a fuel injection nozzle for diffusion combustion disposed in a central portion of the combustor, and an annular premixed nozzle disposed adjacent an outer peripheral portion of the fuel injection nozzle for injecting mixed gas of fuel and air, wherein said annular premixed nozzle comprises an annular premixing chamber and a plurality of premixed fuel nozzles for injecting fuel into said annular premixing chamber, and is divided in a circumferential direction by partition means to form a plurality of premixing chambers each adjacent to said fuel injection nozzle for diffusion combustion, each of said premixing chambers including a plurality of said premixed fuel nozzles;

said partition means comprises at least one plate radially and axially extending to form said plurality of premixing chambers; and a mechanism is provided for supplying fuel to a predetermined number of said premixing chambers in a low load operation of the gas turbine, and for supplying fuel to all of said premixing chambers in a high load operation.

10. A turbine combustor having a fuel injection nozzle for diffusion combustion disposed in a central portion of the combustor, and an annular premixed nozzle disposed adjacent an outer peripheral portion of the fuel injection nozzle for injecting a mixed gas of fuel and air, wherein said annular premixed nozzle comprises an annular premixing chamber and a plurality of premixed fuel nozzles for injecting fuel into said annular premixing chamber, and is divided in a circumferential direction by partition means to form a plurality of premixing chambers each adjacent to said fuel injection nozzle for diffusion combustion, each of said premixing chambers including a plurality of said premixed fuel nozzles;

said partition means includes at least one dividing plate radially and axially extending to form said plurality of premixing chambers;

a fuel control valve is provided on each fuel line for supplying fuel to said plurality of premixed fuel nozzles;

a fuel flow controller is provided for outputting opening control signals to said fuel control valves; and a mechanism is provided for supplying fuel to a predetermined number of said premixing chambers in a low load operation of the gas turbine, and for supplying fuel to all of said premixing chambers in a high load operation.

* * * * *